US006769260B2

(12) United States Patent
Lee et al.

(10) Patent No.: US 6,769,260 B2
(45) **Date of Patent: *Aug. 3, 2004**

(54) REFRIGERATOR FOR COSMETICS AND CONTROL METHOD THEREOF

(75) Inventors: Jae-Seung Lee, Suwon (KR); Myung-Chul Kim, Suwon (KR); Yoon-Young Kim, Suwon (KR); Chang-Hak Lim, Hwasung (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/316,864

(22) Filed: Dec. 12, 2002

(65) Prior Publication Data

US 2003/0226363 A1 Dec. 11, 2003

(30) Foreign Application Priority Data

Jun. 8, 2002 (KR) ..... 2002-32219

(51) Int. Cl.[7] ..... F25B 21/02; F25D 23/12

(52) U.S. Cl. ..... 62/3.6; 62/3.7; 62/259.2

(58) Field of Search ..... 62/3.1–3.7, 258, 62/235.1, 371, 457.1, 457.2, 457.9; 219/219, 385; 312/226, 227

(56) References Cited

U.S. PATENT DOCUMENTS

| | | | | | |
|---|---|---|---|---|---|
| 3,732,702 | A | * | 5/1973 | Desch | 62/3.6 |
| 4,441,329 | A | * | 4/1984 | Dawley | 62/126 |
| 5,325,678 | A | * | 7/1994 | Borah et al. | 62/126 |
| 5,524,440 | A | * | 6/1996 | Nishioka et al. | 62/3.6 |
| 6,021,642 | A | * | 2/2000 | Guinn | 62/3.6 |
| 6,038,865 | A | * | 3/2000 | Watanabe et al. | 62/3.6 |
| 6,091,324 | A | * | 7/2000 | Arsenault et al. | 340/449 |
| 6,398,919 | B1 | * | 6/2002 | Kuboyama | 203/49 |
| 6,481,213 | B2 | * | 11/2002 | Carr et al. | 62/3.2 |

OTHER PUBLICATIONS

U.S. patent application Ser. No. 10/114,308, Yoon–young Kim et al., filed Apr. 3, 2002.

LG Appliances–Refrigerators, http://www.lgappliances.com/cgi–bin/product. (pp. 1–2).

* cited by examiner

*Primary Examiner*—William Doerrler
*Assistant Examiner*—Filip Zec
(74) *Attorney, Agent, or Firm*—Staas & Halsey, LLP

(57) ABSTRACT

A refrigerator includes at least one storage chamber for accommodating cosmetics. The refrigerator further includes electrical parts for maintaining cosmetics accommodated in the storage chamber at appropriate temperature, a control means for controlling operations of checking and displaying failures of the electrical parts, and a display unit for displaying the results of the checking of the failures.

31 Claims, 5 Drawing Sheets

REFRIGERATOR FOR COSMETICS AND CONTROL METHOD THEREOF

CROSS-REFERENCE TO RELATED APPLICATIONS

This application claims the benefit of Korean Application No. 2002-32219, filed Jun. 8, 2002 in the Korean Intellectual Property Office, the disclosure of which is incorporated herein by reference.

BACKGROUND OF THE INVENTION

1. Field of the Invention

The present invention relates to a refrigerator for cosmetics and a control method thereof, which checks for and copes with failures of various electrical parts of the refrigerator.

2. Description of the Prior Art

Generally, cosmetics are apt to spoil because they are stored under a condition in which they are exposed to the air. If the spoiled cosmetics are mistakenly used, there can occur harmful side effects such as blocked pores and skin diseases. Accordingly, it is desirable to store cosmetics in dry and cool places. Therefore, there is an increasing need for a refrigerator for storing cosmetics, and small-sized articles are being developed in consideration of a convenience of use.

SUMMARY OF THE INVENTION

Accordingly, the present invention has been made keeping in mind the above and other problems, and an aspect of the present invention is to provide a refrigerator for cosmetics and a control method thereof, which performs a prompt and convenient checking operation that checks for and displays the failures of various electrical parts, and enhancing the reliability of products by providing a proper countermeasure driving function against the failures of the various electrical parts.

Additional aspects and advantages of the invention will be set forth in part in the description which follows and, in part, will be obvious from the description, or may be learned by practice of the invention.

In order to accomplish the above and other aspects, an embodiment of the present invention provides a refrigerator for cosmetics, the refrigerator comprising a storage chamber to accommodate the cosmetics, electrical parts to maintain the cosmetics accommodated in the storage chamber at an appropriate temperature, a control unit to control operations of checking for and displaying failures of the electrical parts, and a display unit to display the results of the checking for the failures.

In another embodiment of the present invention, a control method of a refrigerator for cosmetics comprises setting a sequence of checks in which to check for failures of electrical parts used to maintain the cosmetics received in a storage chamber at an appropriate temperature, checking the failures of the electrical parts according to the set sequence of checks, and displaying results of the checking for the failures.

BRIEF DESCRIPTION OF THE DRAWINGS

The above and other aspects, features and other advantages of the present invention will be more clearly understood from the following detailed description taken in conjunction with the accompanying drawings, in which.

DESCRIPTION OF THE EMBODIMENTS

Figure 1:
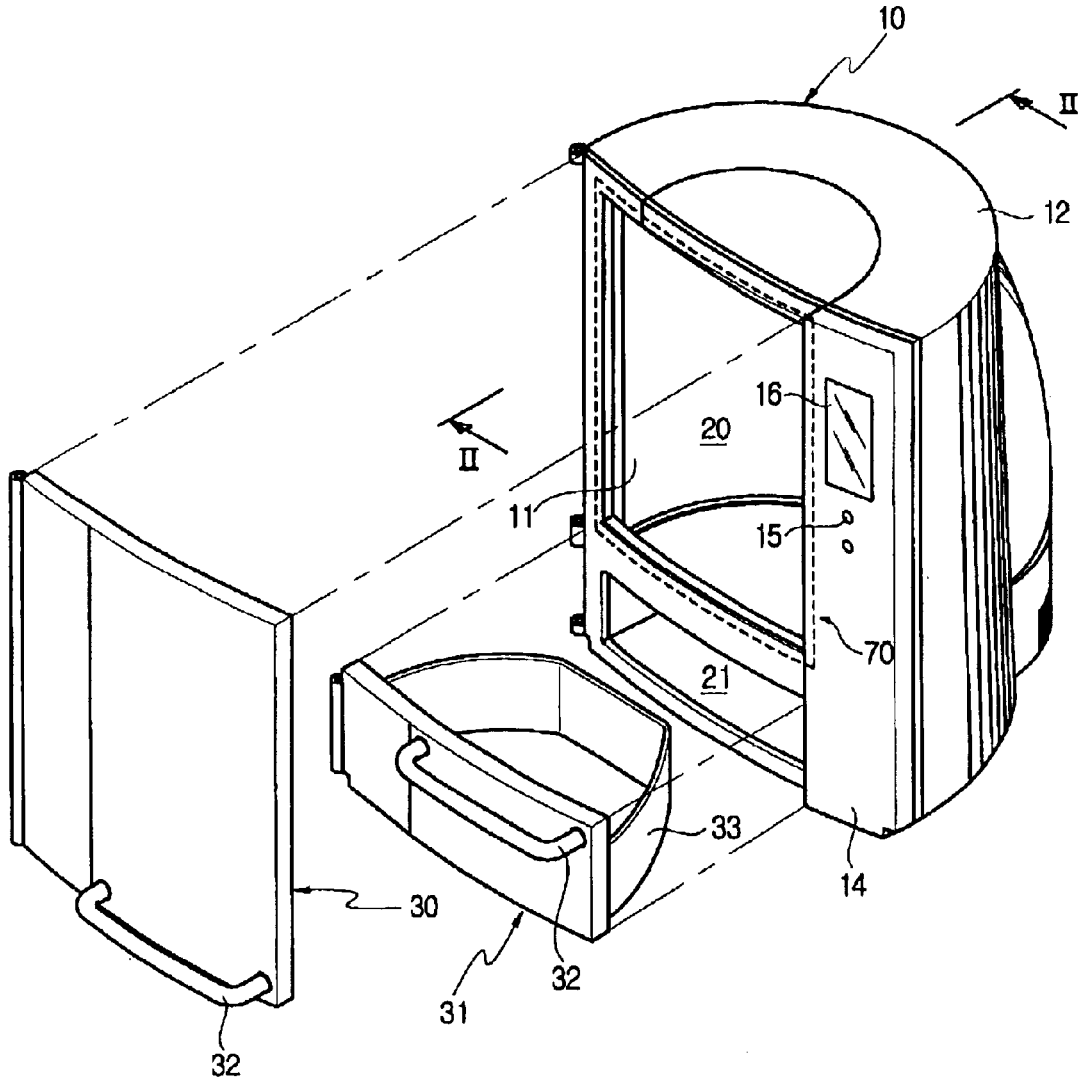
FIG. 1 is an exploded perspective view showing a refrigerator for cosmetics in accordance with an embodiment of the present invention.

Reference now should be made to the drawings in which embodiments of the present invention, examples of which are illustrated in the accompanying drawings, wherein the same reference numerals are used throughout the different drawings to designate the same or similar components. The embodiments are described below in order to explain the present invention by referring to the figures.

The present applicant filed an application entitled "A refrigerator for keeping cosmetics in cold storage using a thermoelectric device and control method thereof" (Korean Patent Appln. No. 2001-64803, filed in the Korean Intellectual Property Office on Oct. 19, 2001 and U.S. patent application Ser. No. 10/114,308, filed in the U.S. Patent and Trademark Office on Apr. 3, 2002), the disclosures of which are incorporated herein by reference. The refrigerator disclosed therein comprises electrical parts including a thermoelectric device, a fan for blowing cold air and various kinds of sensors, which are used to maintain an internal temperature of a storage chamber at a preset temperature. A microcomputer is connected to these electrical parts to control the overall operation of the refrigerator. However, the refrigerator for cosmetics is not provided with a checking function that checks for the occurrence of failures due to errors of the various electrical parts or wrong manipulation by users. On this account, a long-period of time is required to check the various electrical parts in the process of producing the refrigerator for cosmetics. In addition, when a failure occurs during the use of the refrigerator, a service person individually checks the various electrical parts, one by one. Therefore, it is difficult for the service person to find the cause of the failure promptly. In addition, the refrigerator for cosmetics is not provided with a countermeasure driving function to protect against possible abnormal conditions due to the failures of the various electrical parts. Accordingly, there occur potential problems that cosmetics cannot be stored at appropriate temperatures or the like.

Figure 2:
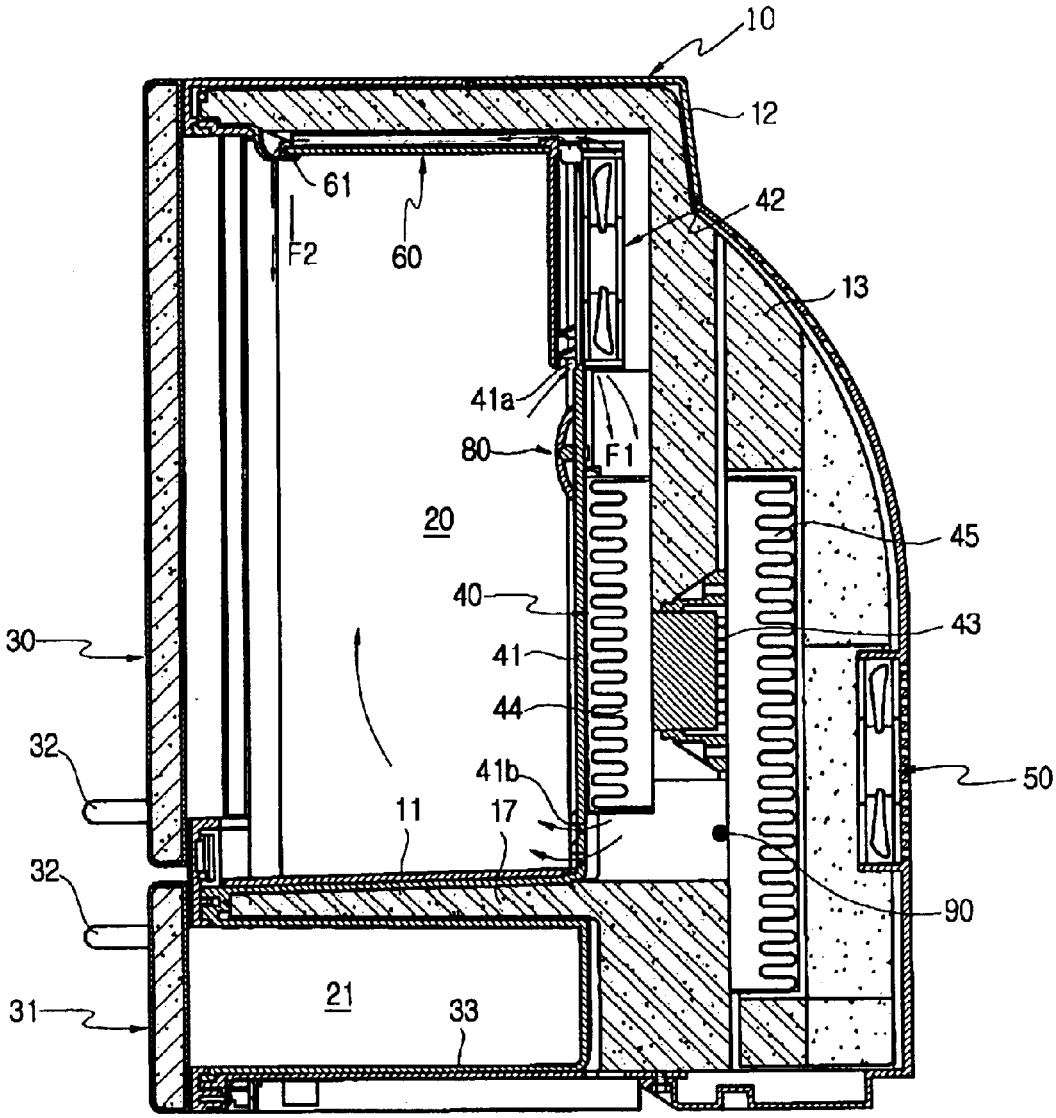
FIG. 2 is a sectional view taken along line II—II of the refrigerator shown in FIG. 1.

As shown in FIGS. 1 and 2, the refrigerator for cosmetics according to an embodiment the present invention comprises a cabinet 10 having storage chambers 20 and 21 with their front sides opened to store cosmetics. Doors 30 and 31 are hingedly coupled to the front sides of the cabinets 10 for selectively opening and closing the storage chambers 20, 21. An apparatus 40 is embedded in a rear wall of the cabinet 10 to supply cold air to the storage chamber 20.

The cabinet 10 comprises an internal case 11, which defines the storage chambers 20 and 21 with their front sides opened. An external case 12 is combined to the open front sides of the internal case 11 so as to enclose the internal case 11. An insulating wall 13 is provided between the internal case 11 and the external case 12 to prevent a heat exchange between the storage chambers and the external environment. In addition, at a portion of the front side of the cabinet 10, there is provided a control panel 14 that is equipped with an input unit 15 to input storage conditions and a display unit 16 to display various operating states, including the storage conditions of the storage chambers 20, 21 and the like.

The storage chambers 20 and 21 are divided by a partition 17 into a main chamber 20, with a relative large capacity, and a sub chamber 21, with a relative small capacity. The main chamber 20 is generally used to store fundamental and functional cosmetics required to be stored in cold places. The sub chamber 21 is generally used to store such cosmetics as lipsticks, cotton, pencils, makeup, etc., not required to be stored in cold places.

In addition, the first door 30 selectively opens and closes the main chamber 20. The second door 31 selectively opens and closes the sub chamber 21. Each of the first and second doors 30 and 31 is provided with a knob 32. A drawer 33 for storing cosmetics is integrally formed at the rear side of the second door 31. It is understood that the above arrangement is only one example of other types of doors, storage chambers, and drawer arrangements that may be used according to the present invention.

The cold air supply apparatus 40 includes a cold air duct 41 provided at a rear wall of the main chamber 20. A blowing fan 42 is incorporated in the cold air duct 41 to circulate air in the main chamber 20. A thermoelectric device 43 is provided under the blowing fan 42 to produce the cold air. A heat emission fan 50 emits heat from the thermoelectric device 43. An air curtain duct 60 branches from the cold air duct 41 and emits cold air from an upper side of the main chamber 20 to a lower side of the main chamber 20.

The cold air duct 41 is integrally formed at a center of a rear wall of the internal case 11, which defines the rear wall of the main chamber 20. An inlet 41*a* to suck air from the main chamber 20 is formed in the upper portion of the cold air duct 41. A cold air outlet 41*b* to discharge cold air produced while passing through an inner side heat exchanger 44 of the thermoelectric device 43, which will be described later, to the main chamber 20 is formed in the lower portion of the cold air duct 41. Accordingly, the cold air outlet 41*b* is located near the bottom of the main chamber 20, and the cold air is discharged toward the bottom of the main chamber 20.

The blowing fan 42 is provided in the upper portion of the cold air duct 41 adjacent to the inlet 41*a* and sucks air from the main chamber 20, and blows most of the air to the inner side heat exchanger 44 of the thermoelectric device 43 (i.e., in a direction indicated by arrow F1). The remainder of the air is blown to the air curtain duct 60 (i.e., in a direction indicated by arrow F2).

The shown embodiment of the thermoelectric device 43 is a Peltier device, in which one side becomes cold and the other side becomes hot by the action of carriers when current flows through a semiconductor (or a conductor). The thermoelectric device 43 is provided in the lower portion of the cold air duct 41 so as to cool the air sucked and blown by the blowing fan 42. The inner side heat exchanger 44, which cools the cold air through heat exchange with the air sucked and blown by the blowing fan 42, is attached to a heat absorption side of the thermoelectric device 43 located toward the main chamber 20. An outer side heat exchanger 45 is attached to the heat generation side of the thermoelectric device 43 located toward an outer side of the cabinet 10.

The heat emission fan 50 is located near the outer side heat exchanger 45 of the thermoelectric device 43, and dissipates heat from the outer side heat exchanger 45 of the thermoelectric device 43 using external air.

A condensation preventing heater 70 is embedded into the external case 12 should condensation occur at a part of the external case 12 in contact with the first door 30.

In addition, a chamber temperature sensor 80 is provided in the upper portion of the cold air duct 41 adjacent to the inlet 41*a* so as to detect the temperature of the main chamber 20. A heat emission temperature sensor 90 is provided at one side of the outer side heat exchanger 45 so as to detect a heat emission temperature. The chamber temperature sensor 80 and the heat emission temperature sensor 90 provide the detected temperature data to a microcomputer 100 shown in FIG. 3. While the shown embodiment provides the cooling air to the main chamber 20, it is understood that the cooling air could also be provided to the sub chamber 21.

Figure 3:
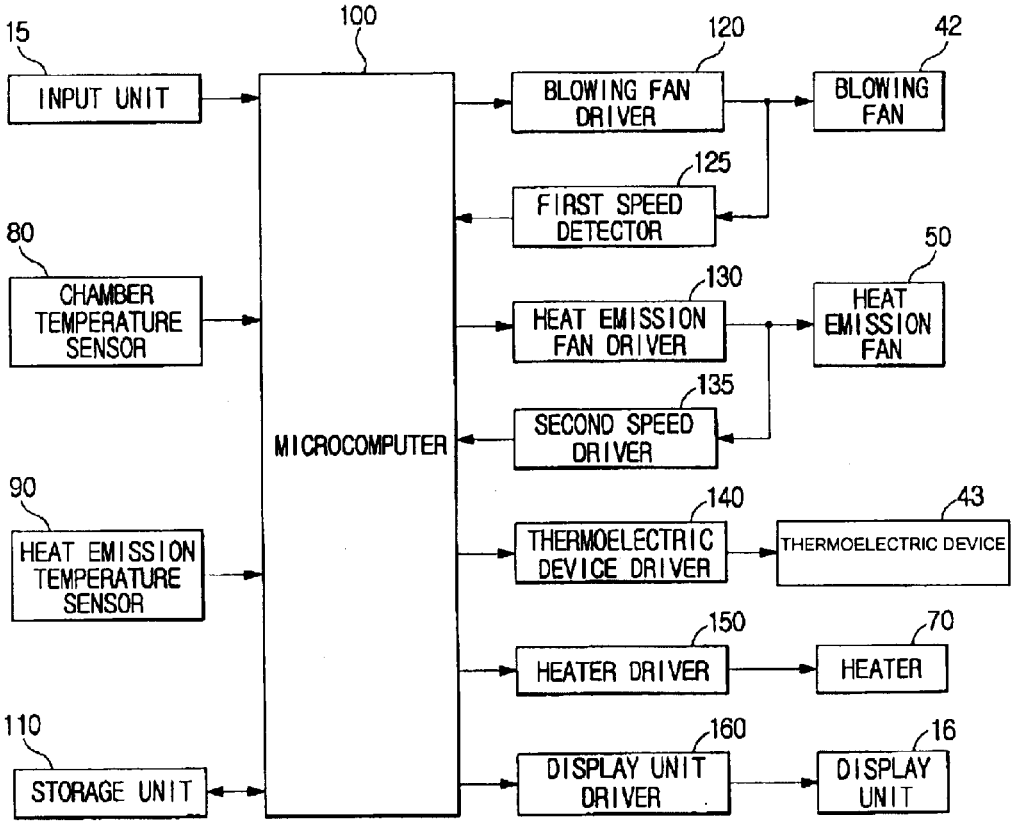
FIG. 3 is a block diagram showing a configuration of the refrigerator for cosmetics according to an embodiment of the present invention.

FIG. 3 is a block diagram showing a configuration of the refrigerator for cosmetics according to an embodiment of the present invention. The refrigerator for cosmetics includes the microcomputer 100 to control the overall operation of the refrigerator. The input side of the microcomputer 100 is electrically connected to the input unit 15, through which a user inputs instructions, the chamber temperature sensor 80 to detect the temperature of the chamber 20, and the heat emission temperature sensor 90 to detect the heat emission temperature. In addition, the microcomputer 100 is electrically connected to a storage unit 110, which stores data required to keep cosmetics in appropriate temperatures. The storage unit 110 may also be used to store computer software used by the microcomputer 100 to control the refrigerator operations.

The output side of the microcomputer 100 is electrically connected to a blowing fan driver 120 to drive the blowing fan 42, a heat emission fan driver 130 to drive the heat emission fan 50, a thermoelectric device driver 140 to drive the thermoelectric device 43, a heater driver 150 to drive the condensation preventing heater 70, and a display driver 160 to drive the display unit 16.

In addition, the input side of the microcomputer 100 is electrically connected to a first speed detector 125 to detect the rotational speed of the blowing fan 42 and a second speed detector 135 to detect the rotational speed of the heat emission fan 50.

The microcomputer 100 checks for the failures of the various electrical parts, as will be described in detail in conjunction with FIG. 4. In addition, the microcomputer 100 has a control program prepared in advance in order to provide a proper countermeasure driving function against the failures of various electrical parts, which are detected by checking for the failures during a normal driving operation.

Figure 4:
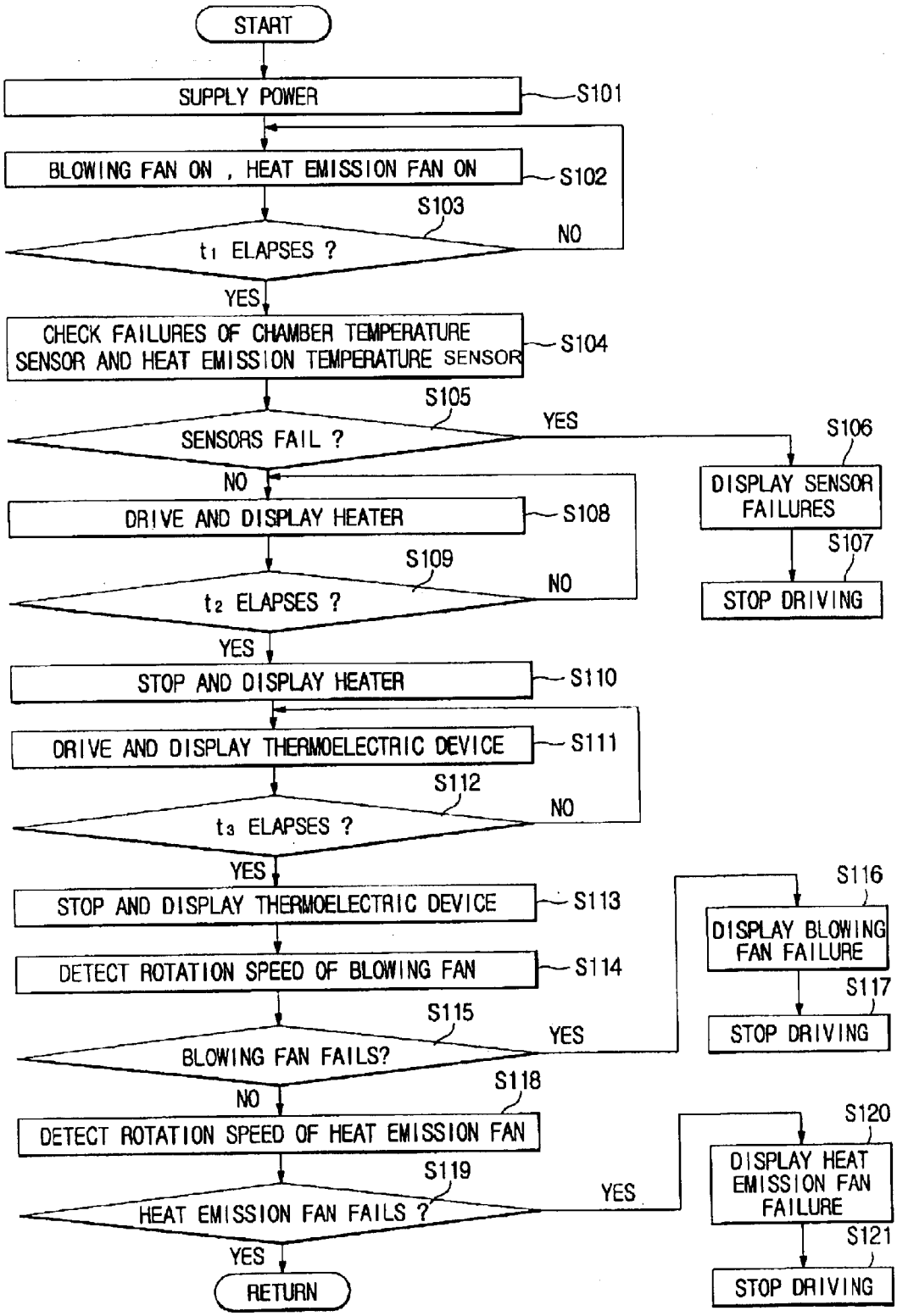
FIG. 4 is a flowchart showing an operation of checking the failures of the refrigerator for cosmetics shown in FIG. 1.

FIG. 4 is a flowchart showing an operation of checking for failures of (i.e., performing diagnostics on) the refrigerator for cosmetics according to an embodiment of the present invention used during the production of the refrigerator. In the embodiment, when the failures of the various electrical parts are to be checked, the blowing fan 42 and the heat emission fan 50 are driven. After the storage chamber 20 reaches a normal temperature after a short time of driving the fans 42, 50, the failures of the various sensors 80, 90 are checked. This is because incorrect checking results can be derived depending on the environment of use or setup if the failures of the sensors 80, 90 are checked without the driving of the fans 42, 50. In addition, the time taken for the rotational speed of the fans 42, 50 to reach a preset speed after the starting of the driving of the fans 42, 50 should be considered in view of characteristics of the fans 42, 50. Accordingly, a total time required to check for the failures can be reduced in such a way that the failures of the sensors 80, 90 are checked after the storage chamber 20 is maintained at the appropriate temperature by driving the fans 42, 50 for a preset period of time, and checking for the failures of the fans 42, 50 after the preset time elapses.

Specifically, in operation S101, power is supplied to the refrigerator for cosmetics. In operation S102, the microcomputer 100 controls the blowing fan driver 120 and the heat emission fan driver 130 to drive the blowing fan 42 and the heat emission fan 50, respectively. In operation S103, the microcomputer 100 determines whether the time taken after the starting of the fans 42, 50 exceeds a preset time t1.

If it is determined that the time does not exceed the preset time t1, the process returns to the operation S102. If it is determined that the counted time exceeds the preset time t1, the failures of the chamber temperature sensor 80 and the heat emission temperature sensor 90 are checked in operation S104. If the sensors 80, 90 are in a short-circuit state or an open-circuit state, which is determined based upon the input values of the sensors 80, 90, the sensors 80, 90 are concluded to have the failures.

On the basis of the checking for the failures, it is determined in operation 105 whether the chamber temperature sensor 80 or heat emission temperature sensor 90 fails. If the chamber temperature sensor 80 or heat emission temperature sensor 90 fails, the failure of a corresponding sensor is displayed on the display unit 16 in operation S106, and the driving of the refrigerator is stopped at operation S107.

If it is determined at operation S105 that the chamber temperature sensor 80 or heat emission temperature sensor 90 has not failed, the microcomputer 100 performs operation S108 in which the condensation preventing heater 70 is driven for another preset time so as to check whether the condensation preventing heater 70 fails (i.e., condensation is prevented from occurring at a part of the external case 12 in contact with the first door 30). While the microcomputer 100 drives the heater 70 for the preset time t2, a user determines whether the heater 70 fails using a separate piece of test equipment that can check the failure on the basis of current consumed by the heater 70, which will be described later. The microcomputer 100 controls the heater driver 150 to drive the condensation preventing heater 70, and the operating state of the heater is also displayed on the display unit 16 during operation S108.

Thereafter, the microcomputer 100 determines in operation S109 whether a time taken after the starting of the heater 70 exceeds a further preset time t2. If it is determined that the time does not exceed the preset time t2, the process returns to the operation S108. If it is determined that the counted time exceeds the preset time t2, the driving of the heater 70 is stopped and the stopping of the heater 70 is displayed on the display unit 16 at operation S110.

After the checking for the failures of the heater 70 are completed, the microcomputer 100 performs operation S110 in which the thermoelectric device 43 is driven for a further preset time so as to check for failures of the thermoelectric device 43 to produce the cold air. While the thermoelectric device 43 is driven for the preset time, a user checks the failures of the thermoelectric device 43 using a separate piece of test equipment, which will be described later. The microcomputer 100 controls the thermoelectric device driver 140 to drive the thermoelectric device 43 and the operating state of the thermoelectric device 43 is also displayed on the display unit 16 at operation S111.

Next, the microcomputer 100 determines in operation S112 whether the time taken after the starting of the thermoelectric device 43 exceeds a preset time t3. If it is determined that the time does not exceed the preset time t3, the process returns to the operation S111. If it is determined that the counted time exceeds the preset time t3, the driving of the thermoelectric device is stopped and the stopping of the thermoelectric device is displayed on the display unit 16 at operation S113.

In operation S114, the microcomputer 100 receives a rotational speed of the blowing fan 42 detected by the first speed detector 125. In operation S115, the microcomputer 100 compares the received rotational speed and a first preset reference speed so as to determine whether the blowing fan 42 has failed. If the detected rotational speed is lower than the first preset reference speed, the blowing fan 42 has failed, the state of the failure is displayed on the display unit 16 at operation S116 and the driving of the refrigerator is stopped at operation S117.

If it is determined at operation S115 that the blowing fan 42 has not failed, the microcomputer 100 receives a rotational speed of the heat emission fan 50 detected by the second speed detector 135 at operation S118. In operation S119, the microcomputer 100 compares the received rotational speed and a second preset reference speed so as to determine whether the heat emission fan 50 fails. If the detected rotational speed is lower than the second preset reference speed, the heat emission fan 50 has failed, the state of the failure is displayed on the display unit 16 at operation S120 and the driving of the refrigerator is stopped at operation S121. If it is determined at operation S119 that the heat emission fan 50 has not failed, the process returns so as to terminate the checks of the failures.

Figure 5:
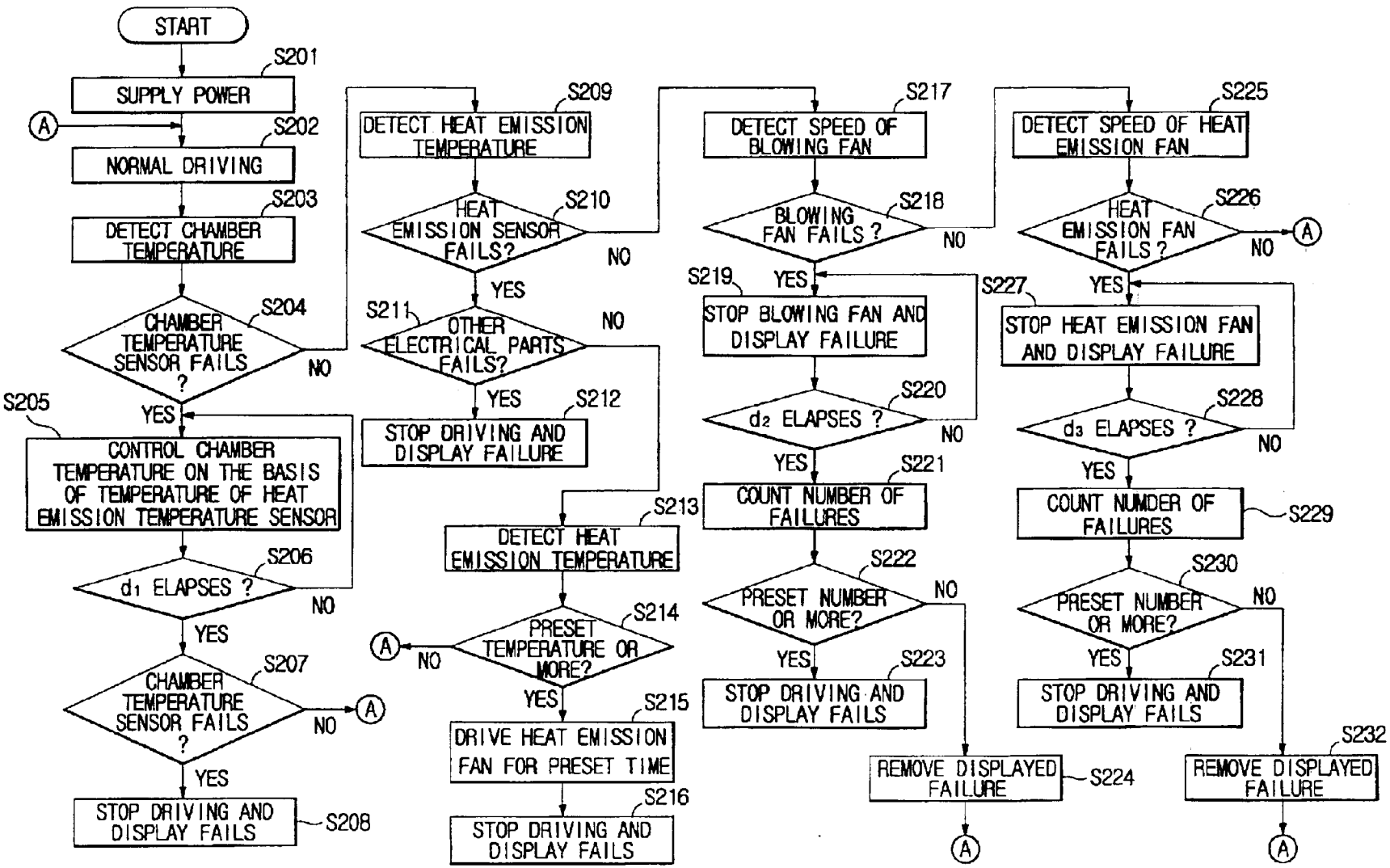
FIG. 5 is a flowchart showing an operation of coping with the failures of the refrigerator for cosmetics shown in FIG. 1.

FIG. 5 is a flowchart showing operations of detecting and coping with the failures of the refrigerator for cosmetics in accordance with an embodiment of the present invention. In operation S201, the power is supplied to the refrigerator. In operation S202, the microcomputer 100 performs a normal driving operation to maintain the temperature of the storage chamber 20 at an appropriate temperature on the basis of storage conditions inputted via the input unit 15 and controls the operations of the various electrical parts under the normal driving conditions.

In operation S203, the microcomputer 100 receives a chamber temperature detected by the chamber temperature sensor 80. In operation S204, the microcomputer 100 determines whether the sensor 80 fails on the basis of the detected chamber temperature. Specifically, in operation S204, the microcomputer 100 determines whether the sensor 80 fails by determining whether the sensor 80 is in a short-circuit state or an open-circuit state, which is determined on the basis of the values of signals inputted from the sensor 80.

If it is determined at operation 204 that the chamber temperature sensor 80 has failed, the microcomputer 100 controls the temperature of the storage chamber 20 based upon the heat emission temperature detected by the heat emission temperature sensor 90 at operation S205. Specifically, the relationship between the chamber temperature and the heat emission temperature is experimentally determined. The microcomputer 100 stores the experimental data on the temperature in the storage unit 110, and, during operation S205, controls the temperature of the storage chambers 20 based on an estimated chamber temperature corresponding to the detected heat emission temperature using the stored temperature data.

In operation S206, the microcomputer 100 determines whether a time taken after the starting of the heat emission temperature sensor 90 exceeds a preset time d1. If it is determined that the time does not exceed the preset time d1, the process returns to the operation S205. If it is determined that the time exceeds the preset time d1, it is determined in operation S207 whether the chamber temperature sensor 80 fails again on the basis of the values of signals inputted from the chamber temperature sensor 80, as described above. If it is determined that the chamber temperature sensor 80 fails, the microcomputer 100 displays the failure on the display unit 16 and stops the driving of the refrigerator at operation S208. If it is determined at operation S207 that the chamber temperature sensor 80 has not failed, the process returns to operation S202 to perform the normal driving operation.

If it is determined at operation S204 that the chamber temperature sensor 80 has not failed, the microcomputer 100 receives the heat emission temperature detected by the heat emission temperature sensor 90 at operation S209, and determines in operation S210 whether the heat emission temperature sensor 90 has failed on the basis of the detected heat emission temperature. In operation S210, the microcomputer 100 determines whether the sensor 90 has failed by determining whether the sensor 90 is in a short-circuit state or an open-circuit state, which is determined based on the values of signals inputted from the sensor 90.

If it is determined at operation S210 that the heat emission temperature sensor 90 has failed, the microcomputer 100 determines in operation S211 whether other electrical parts (such as the chamber temperature sensor 80, the thermoelectric device 43, etc.) have failed. If it is determined that the other electrical parts have failed, the microcomputer 100 displays the failures on the display unit 16 and stops the driving of the refrigerator at operation S212.

If it is determined at operation S211 that the other electrical parts have not failed, the heat emission temperature is detected at operation S213. In operation S214, it is determined whether the detected heat emission temperature exceeds a preset temperature in order to determine whether the outer-side heat exchanger 45 is overheated at. If it is determined that the detected heat emission temperature exceeds the preset temperature, the microcomputer 100 controls the heat emission fan driver 130 to drive the heat emission fan 50 for a preset time so as to prevent the overheating of the heat exchanger 45 at operation S215. In operation S216, the microcomputer 100 displays the overheated state of the heat exchanger 45 on the display unit 16, and stops the driving of the refrigerator. If it is determined at operation S214 that the detected heat emission temperature does not exceed the preset temperature, the process proceeds to operation S202 to perform the normal driving operation.

If it is determined at operation S210 that the heat emission temperature sensor 90 has not failed, the microcomputer 100 detects in operation S217 the rotational speed of the blowing fan 42 through the first speed detector 125. In operation S218, the microcomputer 100 compares the detected rotational speed of the blowing fan 42 and a first preset reference speed so as to determine whether the blowing fan 42 has not failed. If it is determined that the blowing fan 42 has failed, the microcomputer 100 stops the blowing fan 42 and displays the failure on the display unit 16 at operation S219.

In operation S220, the microcomputer 100 determines whether a time after the stopping of the blowing fan 42 exceeds a preset time d2. If it is determined that the time does not exceed the preset time d2, the process returns to operation S219. If it is determined that the counted time exceeds the preset time d2, the number of failures are counted at operation S221. In operation S222, it is determined whether the counted number of failures exceed a preset number.

If it is determined at operation S222 that the counted number of failures exceeds the preset number, the microcomputer 100 displays the failure of the blowing fan 42 on the display unit 16 and stops the driving of the refrigerator at operation S230. If it is determined at operation S222 that the counted number of failures does not exceed the preset number, the failure displayed on the display unit 16 is removed at operation S224 because the failure of the blowing fan 42 may occur due to a transitory phenomenon. The process proceeds to operation S202 to perform the normal driving operation.

If it is determined at operation S218 that the blowing fan 42 has not failed, the microcomputer 100 detects the rotational speed of the heat emission fan 50 through the second speed detector 135 at operation S225. In operation S226, the microcomputer 100 compares the detected rotational speed of the heat emission fan 50 and a second preset reference speed so as to determine weather the heat emission fan 50 has failed. If it is determined that the heat emission fan 50 has failed, the microcomputer 100 stops the driving of the heat emission fan 50, and displays the failure on the display unit 16 at operation S227.

In operation S228, the microcomputer 100 determines whether a time after the stopping of the heat emission fan 50 exceeds a preset time d3. If it is determined that the time does not exceed the preset time d3, the process returns to the operation S227. If it is determined that the counted time exceeds the preset time d3, the number of failures is counted at operation S229. In operation S230, it is determined whether the counted number of failures exceeds a preset number.

If it is determined at operation S230 that the counted number of failures exceeds the preset number, the microcomputer 100 displays the failure of the heat emission fan 50 on the display unit 16 and stops the driving of the refrigerator at operation S231. If it is determined at operation S230 that the counted number of failures does not exceed the preset number, the failure displayed on the display unit 16 is removed at operation S232 because the failure of the heat emission fan 50 may occur due to a transitory phenomenon. The process proceeds to operation S202 to perform the normal driving operation.

As described above, the present invention provides a refrigerator for cosmetics provided with a checking function that checks for the occurrence of failures due to errors of the various electrical parts or a wrong manipulation by users and a control method thereof. Accordingly, a checking operation of the various electrical parts can be performed promptly and conveniently in the process of operating the refrigerator for cosmetics. In addition, when the failures of the various electrical parts are to be checked, the blowing fan and the heat emission fan are first driven, failures of various sensors are checked after the temperature of the storage chambers reaches a normal temperature in a short time, and then the failures of the blowing fan and the heat emission fan are checked to provide diagnostic results. Accordingly, a total time required to check for the failures can be reduced.

In addition, according to the present invention, by providing a proper countermeasure driving function against the failures of various electrical parts occurring during a normal driving, appropriate countermeasures can be taken against the transitory failures of the various electrical parts and a reliability of products can be enhanced.

Further, while described in terms of a refrigerator for cosmetics, it is understood that the control method could be used in other types of refrigerators, or for other devices in which a temperature is maintained at a specified level. It is additionally understood that, while a display is used to provide results, that other mechanisms are available to provide results. Such mechanisms includes, but are not limited to, audio alarms and/or instructions, or other non-visual devices.

Although the embodiments of the present invention have been disclosed for illustrative purposes, those skilled in the art will appreciate that various modifications, additions and substitutions are possible, without departing from the scope and spirit of the invention as disclosed in the accompanying claims and equivalents thereof.

What is claimed is:

1. A refrigerator for cosmetics comprising:

a housing including a storage chamber to accommodate the cosmetics;

electrical parts to maintain the cosmetics accommodated in the storage chamber at an appropriate temperature;

a controller to control operations of the electrical parts, to check the electrical parts to produce diagnostic results, and to display failures of the electrical parts; and a display unit to display the diagnostic results including the failures.

2. The refrigerator according to claim 1, wherein the electrical parts comprise one of:

a chamber temperature sensor to detect the temperature of the storage chamber, a thermoelectric device to produce cold air to be supplied to the storage chamber, a blowing fan to blow the cold air, a heat emission fan to remove heat from the thermoelectric device, a heat emission temperature sensor to detect the heat emission temperature of the heat removed by the heat emission fan, and a heater to prevent condensation from occurring at a part of the housing in contact with a door used to selectively open and close the storage chamber.

3. The refrigerator according to claim 2, wherein:

the electrical parts comprise the chamber temperature sensor or the heat emission temperature sensor, and the controller determines whether the chamber temperature sensor or the heat emission temperature sensor has failed based upon values of signals inputted from the chamber temperature sensor or the heat emission temperature sensor.

4. The refrigerator according to claim 3, wherein the controller:

checks for failures of the chamber temperature sensor or the heat emission temperature sensor and determines a number of times the chamber sensor or the heat emission temperature sensor has failed, and if the number of the failures exceeds a first preset number, stops the operation of the refrigerator.

5. The refrigerator according to claim 2, wherein the controller checks for the failures of the electrical parts according to a preset sequence.

6. The refrigerator according to claim 5, wherein:

the electrical parts comprise the chamber temperature sensor, the heat emission temperature sensor, the blowing fan, and the heat emission driving fan, and the controller performs checks for failures of the chamber temperature sensor and the heat emission temperature sensor after the blowing fan and the heat emission fan are driven.

7. The refrigerator according to claim 6, wherein the controller performs checks for the failures of the blowing fan and the heat emission fan after checking for the failures of the chamber temperature sensor and the heat emission temperature sensor.

8. The refrigerator according to claim 2, wherein:

the electrical parts comprise the heater, the controller drives the heater for a preset time, and the controller stops driving the heater after the preset time and checks for failures of the heater after the heater is no longer driven.

9. The refrigerator according to claim 2, wherein:

the electrical parts comprise the blowing fan and the heat emission fan, the electrical parts further comprise speed detectors to detect rotational speeds of the blowing fan and the heat emission fan, the controller determines whether the blowing fan and the heat emission fan fail by comparing the detected rotational speeds and preset speeds so as to check for failures of the blowing fan and the heat emission fan.

10. A refrigerator for cosmetics comprising:

a housing including a storage chamber;

electrical parts to maintain a temperature of the storage chamber at an appropriate temperature;

a failure checking unit that checks failures of the electrical parts in a sequence so as to produce checking results; and a display unit which displays the checking results.

11. A control method to control a refrigerator for cosmetics, the method comprising:

setting a sequence of checking for failures of electrical parts used to maintain the cosmetics received in a storage chamber at an appropriate temperature;

checking for the failures of the electrical parts according to the sequence; and displaying results of the checking for the failures.

12. The control method according to claim 11, further comprising driving fans so that a temperature of the storage chamber reaches the appropriate temperature after setting the sequence.

13. The control method according to claim 12, wherein the driving of the fans comprises simultaneously driving a blowing fan used to supply cold air produced by a thermoelectric device to the storage chamber and driving a heat emission fan used to remove heat from the thermoelectric device.

14. The control method according to claim 12, wherein the checking for the failures comprises checking failures of a chamber temperature sensor used to detect the temperature of the storage chamber and a heat emission temperature sensor used to detect a temperature of a heat emission unit after the driving of the fans.

15. The control method according to claim 14, wherein the checking for the failures of the chamber temperature sensor and the heat emission temperature sensor comprises determining whether the chamber temperature sensor and the heat emission temperature sensor fail based upon values of signals inputted from the chamber temperature sensor and the heat emission temperature sensor.

16. The control method according to claim 15, wherein the checking for the failures of the chamber temperature and heat emission sensors further comprises:

determining a number of times the chamber temperature and heat emission sensors have failed, and stopping a driving of the refrigerator if the number of the failures exceeds a first preset number.

17. The control method according to claim 11, where the checking for the failures comprises checking for failures of a heater used to prevent condensation from occurring at a part of the storage chamber in contact with a door used to selectively open and close the storage chamber.

18. The control method according to claim 17, wherein the checking for the failures of the heater comprises driving the heater for a preset time and stopping the driving of the heater.

19. The control method according to claim 14, wherein the checking for the failures further comprises:

detecting rotational speeds of the fans driven after checking for the failures of the chamber temperature sensor and the heat emission temperature sensor, and determining whether the fans fail by comparing the detected rotational speeds of the fans and preset reference speeds.

20. The control method according to claim 11, wherein the checking for the failures of the electrical parts are performed periodically.

21. A computer readable medium encoded with processing instructions for implementing a method of diagnosing and coping with failures of components used in running a refrigerator performed by a computer, the method comprising:

during a normal operation of the components in running the refrigerator, performing a diagnostic test on the components in a pre-selected order to detect a failure of one of components; and selectively controlling the components to continue the normal operation of the refrigerator based upon a result of the diagnostic test.

22. The computer readable medium of claim 21, wherein the performing of the diagnostic test comprises:

checking whether a first sensor has failed according to a first test, and if the first sensor has failed, controlling the components to control a temperature of a chamber of the refrigerator using a second sensor.

23. The computer readable medium of claim 22, wherein the controlling of the components using the second sensor comprises:

detecting a second temperature using the second sensor, and estimating the temperature of the chamber based upon a predetermined relationship between the second temperature and the temperature of the chamber.

24. The computer readable medium of claim 23, wherein the performing of the diagnostic test further comprises:

after controlling the components using the second sensor for a predetermined amount of time, again checking the first sensor using the first test and determining whether the first sensor has again failed the first test, and if the first sensor has again failed, controlling the components to stop the normal operation of refrigerator and outputting information regarding the failure of the first sensor.

25. The computer readable medium of claim 22, wherein the performing of the diagnostic test further comprises:

if the first sensor has not failed, performing a second test on the second sensor to determine whether the second sensor has failed, and if the second sensor has failed, the diagnostic test further comprises performing an additional test on a further component of the refrigerator to determine whether the further component has failed.

26. The computer readable medium of claim 25, wherein the performing of the diagnostic test further comprises:

if the second sensor has failed and the further component has failed, controlling the components to stop the normal operation of the refrigerator.

27. The computer readable medium of claim 25, wherein the diagnostic test further comprises:

if the second sensor has failed and the further component has not failed, detecting a second temperature using the second sensor, if the second temperature does not exceed a preset temperature, controlling the components to continue the normal operation of the refrigerator, and if the second temperature does exceed the preset temperature, controlling the components to stop the normal operation of the refrigerator.

28. The computer readable medium of claim 27, wherein the diagnostic test further comprises:

if the second temperature does exceed the preset temperature, driving a heat emission fan to remove heat from the refrigerator for a predetermined amount of time and then controlling the components to stop the normal operation of the refrigerator.

29. The computer readable medium of claim 25, wherein the diagnostic test further comprises:

if the second sensor has not failed, detecting a speed of a fan used to control the temperature of the chamber, comparing the detected speed with a preset speed, and stopping an operation of the fan if the comparison of the detected speed and the preset speed indicates the fan has failed.

30. The computer readable medium of claim 29, wherein:

the detecting the speed of the fan further comprises detecting a number of times the fan has failed, if the number of times exceeds a preset number, stopping the operation of the fan, and if the number of times is does not exceed the preset number, the diagnostic test further comprises controlling the components to continue the normal operation.

31. The computer readable medium of claim 29, wherein the diagnostic test further comprises:

if the fan has not failed, determining whether another fan used to control the temperature of the chamber has failed, detecting a number of times the another fan has failed, if the number of times exceeds a preset number, stopping the operation of the another fan, and if the number of times is does not exceed the preset number, the diagnostic test further comprises controlling the components to continue the normal operation.

* * * * *